United States Patent [19]

Burczynski

[11] Patent Number: 4,947,755

[45] Date of Patent: Aug. 14, 1990

[54] BULLET HAVING SECTIONS SEPARABLE UPON IMPACT

[76] Inventor: Thomas J. Burczynski, P.O. Box 248, Odessa, N.Y. 14869

[21] Appl. No.: 444,394

[22] Filed: Dec. 1, 1989

[51] Int. Cl.[5] ..... F42B 12/34

[52] U.S. Cl. ..... 102/506; 102/501; 102/507; 102/508

[58] Field of Search ..... 102/501, 506–510, 102/514

[56] References Cited

U.S. PATENT DOCUMENTS

| | | | |
|---|---|---|---|
| 90,732 | 6/1869 | Curtis | 102/506 |
| 219,840 | 9/1879 | Winchester | 102/506 |
| 4,716,834 | 1/1988 | Wallow et al. | 102/506 |
| 4,836,110 | 6/1989 | Burczynski | 102/508 |

FOREIGN PATENT DOCUMENTS

| | | | |
|---|---|---|---|
| 7915 | of 1893 | United Kingdom | 102/507 |

*Primary Examiner*—Charles T. Jordan
*Assistant Examiner*—Rochelle Lieberman
*Attorney, Agent, or Firm*—Charles S. McGuire

[57] ABSTRACT

A rifle or handgun bullet having a cylindrical base and a leading end of ogival shape extending for a portion of its length is divided into a plurality of sections by parting lines extending radially inwardly from the outer periphery of the body towards the central axis and terminating along lines spaced from the central axis of the bullet. The parting lines extend longitudinally the full axial length of the body of the bullet and, upon impact with a lubricious target, the bullet separates into individual sections which travel separately and create a plurality of impinging pressure zones within the target. The bullet is disclosed in embodiments with and without a frusto-conical cavity extending into the forward, blunt end, terminating in a plane through the juncture of the base and leading end. In the embodiment having the cavity, the radial parting lines terminate outwardly of the cavity wall.

13 Claims, 2 Drawing Sheets

BULLET HAVING SECTIONS SEPARABLE UPON IMPACT

BACKGROUND OF THE INVENTION

The present invention relates to novel bullet constructions, and more specifically to a bullet weakened by a plurality of parting lines which promote a pronounced splitting action and subsequent separation of the bullet into individual segments upon impact with and entry into a target.

The prior art contains numerous examples of bullets which are designed to spread or expand upon impact. Such bullets include those known as mushrooming bullets, normally having a soft point of exposed lead or a hollow area in the tip. Some bullets of this type have weakened jackets to facilitate expansion, such as those of U.S. Pat. Nos. 1,114,356, 1,715,788, 2,045,964, 3,143,966, 3,157,137, 4,193,348 and 4,655,140. Further examples of expanding bullets having variously configured cavities in the tip or nose which function effectively with or without a jacket are found in U.S. Pat. Nos. 3,881,421 and 4,550,662 of the present inventor. Other examples of expanding bullets such as those found in U.S. Pat. Nos. 1,135,357, 1,833,645, 2,661,694 and 3,991,684 are composite in nature, utilizing various "spreader" devices located in their tips which are physically driven back into the core of the bullet during impact, causing expansion. The bullets of U.S. Pat. Nos. 1,135,357 and 1,833,645 are apparently designed to expand and remain in singular form after impact, whereas the bullets disclosed in U.S. Pat. Nos. 2,661,694 and 3,991,684 are designed to expand and thereafter fragment or otherwise separate into pieces.

Mushrooming and other expanding bullets are intended to provide improved "stopping action" as compared to solid, non-expanding bullets. Although the bullet designs of the aforementioned patents exhibit various types of expanding action, they are, with the exception of U.S. Pat. Nos. 2,661,694 and 3,991,684, intended to remain in monoblock form after impact with the target; that is, the bullet material does not separate into two or more individual pieces.

Another approach to improving bullet performance can be found in U.S. Pat. Nos. 4,836,110 and 4,882,822 of the present inventor, wherein a portion of the bullet body, or in the case of a jacketed bullet, the bullet core is divided longitudinally and radially into a plurality of sections by parting lines. Upon impacting a fluidic target, the bullet, being internally weakened, separates into a plurality of individual parts which travel in different directions.

Somewhat similar designs exist which utilize various, slots, slits, cuts, passages, spaces and the like within the bullet core, or in the case of an unjacketed bullet, within the bullet body itself. Some of these designs, such as those disclosed in U.S. Pat No. 3,138,102, which is actually a shotgun slug, and U.k. Complete Specification No. 4,426 and U.K. Provisional Specification No. 14,717 were designed to maintain monoblock characteristics during flight, while providing enhanced expansion characteristics upon impacting a fluidic target. The hollow point shotgun slug of U.S. Pat. No. 3,138,102 is designed to initiate a controlled break-up during penetration of a target. Another early U.S. Pat. No. 219,840, while pertaining solely to the fabrication method employed in making the body of a bullet, does show the bullet produced from such manufacture.

Still others, such as those found in U.S. Pat. Nos. 90,732 and 3,097,603 are so weakly constructed that they can fly to pieces during flight, giving the effect of a shotgun blast of multiple fragments.

OBJECTS OF THE INVENTION

It is a principal object of the present invention to provide an easily manufactured rifle or pistol bullet having greatly improved stopping power upon impact with a living target.

A further object is to provide a novel bullet of improved design having high stability during flight, thus being capable of exceptional accuracy, while at the same time producing a higher degree of incapacitation than is possible using a comparable bullet of the hollow-nosed or soft-nosed type.

Another object is to provide a structurally weakened bullet which is initially of monoblock form, and remains so during flight, but which separates into a plurality of individual parts or fragments upon impact with a fluidic target when fired at medium to high velocity, thereby taking advantage of multiple force vectors and imparting greater shock and damage to a living target.

A further object is to provide a bullet which, upon impacting a living target, splits into a plurality of individual sections which travel radially outwardly from the axis of initial impact within the target, creating multiple wound cavities and impinging pressure zones and thereby increasing the chance of striking or affecting one or more vital organs.

Other objects will in part be obvious and will in part appear hereinafter.

SUMMARY OF THE INVENTION

In accordance with the foregoing objects, the invention contemplates a bullet having the external configuration of a conventional hollow point or solid, soft-nosed bullet, with or without internal cavities, with a tapered or ogival nose. The bullet is formed from an initially cylindrical length of lead, lead alloy, or other such malleable metal, which is extruded through a die having three or more longitudinal arms projecting radially inwardly. The extrusion die divides the cylindrical length of material from the outer periphery inwardly along three or more radial gaps or spaces which stop short of the central axis. That is, the material is divided into a plurality of integral, longitudinally extending "lobes" or fan-shaped portions which remain joined along a solid, longitudinally extending central "hub" of substantially uniform thickness.

The cylindrical length of metal thus divided is then placed in a profile die where it is compressed radially inwardly, forcing the separated sections or lobes into tight engagement thereby forming longitudinally extending, axially adjoining sections, with opposing faces in tight engagement along radial parting lines, while at the same time forming a tapered or ogival nose portion extending from one end for a portion of the axial length of the finished bullet. In the case of a hollow point bullet, a cavity is formed in the nose portion at the same time the nose is formed. Conventional jacketing of the bullet may be added, or not, as desired.

In the case of a hollow point bullet, the tightly engaged, longitudinally extending portions remain joined (within part or all of the nose portion (sometimes in the shank area, depending upon the depth of the hollow point)) along adjacent inner edges by relatively thin "webs" which are positioned outwardly of the central cavity and are integral with a solid, longitudinally extending central hub or solid area, which begins at the bottom of the cavity and terminates at the bullet's base. The webs joining the longitudinally extending, fan-shaped portions at their inner edges are thick enough to prevent separation during flight, but thin enough to ensure separation into individual pieces upon impact with a fluidic target. Preferred maximum and minimum thicknesses of the webs are 0.150 and 0.005 inch, respectively.

In the case of a solid, or soft-nosed bullet, the longitudinally extending portions remain integrally joined by a solid, longitudinally extending central hub or solid area which begins at the bullet's nose and terminates at the bullet's base. This hub ensures that the bullet will remain in monoblock form during flight, but will alos allow the bullet to separate into individual pieces upon impact with a fluidic target while achieving substantially deeper penetration than its hollow point counterpart.

DETAILED DESCRIPTION

Figure 1:
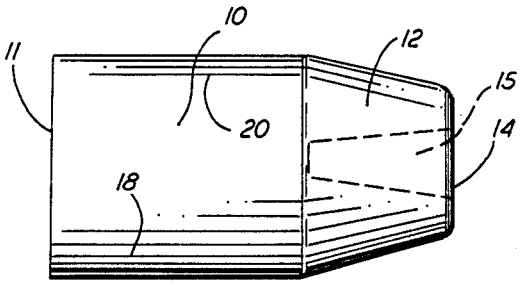
FIG. 1 is a side elevational view of a first embodiment of the bullet of the present invention.
Figure 2:
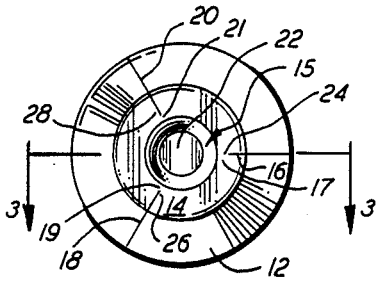
FIG. 2 is an end view from the forward or nose end of the bullet of FIG. 1.
Figure 3:
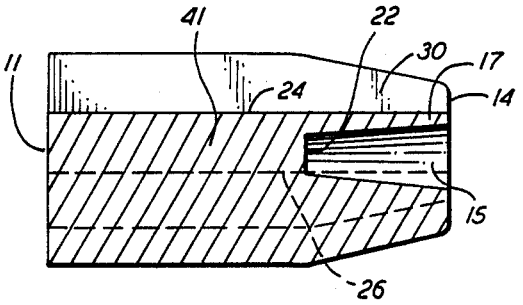
FIG. 3 is a sectional view taken on the line 3—3 of FIG. 2.

A preferred form of a first embodiment of the bullet of the invention is shown in side elevation in FIG. 1, comprising a cylindrical shank portion 10 and a tapered, forward, nose portion 12 having a flat or blunt forward end 14. In the embodimnet of FIGS. 1–3, hollow, frusto-conical cavity 15 extends centrally into nose, portion 12 from forward end 14. Thus, the bullet has an entirely conventional appearance from the side, and may be inserted and crimped in the usual manner into a cartridge case (not shown) containing a powder charge and a primer. It will be undestood, however, that the present invention is concerned only with the bullet. Furthermore, as pointed out hereinafter, the bullet may be partly of fully clad in a metal jacket, but the invention is entirely independent of whether or not the bullet is jacketed. In the end view of FIG. 2, the bullet is seen to differ from conventional bullets of similar configuration by including three radial slits or parting lines 16, 18 and 20 arranged at sustantially equal, 120° angles, on blunt end 14. In the sectional view of FIG. 3, the parting lines are seen to extend from end 14 through the entire length of the bullet and terminate at the bullet's base 11.

As explained later in more detail, the bullet may include three or more radial parting lines, all of which begin at the flat, forward end and extend through outer portions of the bullet body longitudinally for the full length thereof, terminating at its base. As is evident from FIGS. 2 and 3, parting lines 16, 18 and 20 extend from the outer periphery of the bullet, radially inwardly and terminate outwardly of the cavity 15 situated in the nose area of the bullet. That is, while the parting lines extend completely through the body of the bullet longitudinally, in no instance does any parting line extend entirely through the body of the bullet radially. The inner terminations of parting lines 16, 18 and 20 are indicated in FIG. 2 by reference numerals 24, 26 and 28, respectively.

Inner terminations 24 and 26 of parting lines 16 and 18, respectively, are also seen in FIG. 3. Although the adjacent faces on each side of the parting lines are in intimate contact, they are not joined or affixed to one another in any way. One of the faces on opposite sides of parting line 16, through which the section is taken, is seen in FIG. 3 and denoted by reference numberal 30. The inner terminations 24 and 26 of the parting lines 16 and 18 are seen to lie substantially (or relatively) parallel to the axis of the bullet, but can, in some instances, lie at a slight angle in relation to the bullet's axis.

As the inner terminations 24, 26 and 28 of parting lines 16, 18 and 20 stop short of the frusto-conical cavity 15, web indicated in FIG. 2 by reference numerals 17, 19 and 21 are formed. These web areas serve to maintain bullet integrity during flight and further serve to control the rapidity of separation and the degree and angle of dispersion of the individual bullet segments as the webs tear in a uniform manner along parting lines during penetration of a fluidic target. One of the webs (17), is also seen in the sectional view of FIG. 3.

It should be understood that web thickness can vary from caliber to caliber, and is primarily dependent upon the inherent muzzle velocity of a specific cartridge and the particular use to which the bullet is to be put. It should be clear that, as a natural consequence of radially shortening the parting lines, the web areas thickness increase proportionately. As can be seen from FIG. 3, the web area 17 (as well as web areas 19 and 21) begins at the nose 14 of the bullet and thickens as it extends toward the base 22 of the frusto-conical cavity 15, due to the inwardly tapering side wall of the cavity. From cavity base 22, the web areas merge into a solid, central area 41 that extends to the base 11 of the bullet. It is preferred that the parting lines all maintain a proportionately uniform distance through the nose and shank portions from the outer periphery of the bullet and terminate along lines spaced by a distance between about 0.005" and 0.150" from the cavity opening in a hollow point form of the bullet and by a distance between about 0.020" and 0.200" from the central axis in the solid or soft-nosed version, described hereinafer, depending on caliber.

Thus, the bullet of the invention may be characterized as having a plurality of sections, separated by parting lines which extend longitudinally from the bullet's nose to its base, and extend radially inwardly from the bullet's outer periphery toward the central axis where the parting lines terminate, yet remaining integral in that all adjacent sections are joined over at least some areas. The principal distinguishing feature of the bullet is that it remains intact, i.e., completely unitary in form, when fired and during flight, until striking and entering a fluidic target such as flesh, organs or other tissue, and then divides into separate sections which travel in different directions through the target. In the case of the bullet of FIGS. 1–3, the bullet will separate into three totally separate and distinct sections, which are the adjacent sections on opposite sides of each of the three parting lines. The advantages and effect of this characteristic are explained later in detail.

Figure 4:
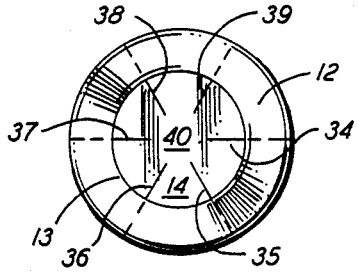
FIG. 4 is an end view, as in FIG. 2, of a second form of the bullet of the invention.

The soft-point bullet of FIG. 4 is shown in end view to illustrate that a number of parting lines greater than three may be provided. A jacket (not numbered) extends all the way from the base to the nose of the bullet and is termination is indicated by reference numeral 13. Since the exterior configuration is the same as that of FIGS. 1–3, reference numerals 12 and 14 are again used to denote the tapered nose portion and blunt forward end, respectively. A total of 6 parting lines, numbered 34 through 39, extend radially inwardly from the outer periphery of the bullet core (not numbered), and terminate radially a relatively uniform distance from the central axis of the bullet. This creates a longitudinally solid, central area 40 which extends the entire length of the bullet from the blunt, forward end of the nose of the bullet to the bullet's base. The limits of the parting line dimensions and other parameters can differ substantially from those in the previously described embodiment. That is, the parting lines of FIG. 4 extend radially inwardly (toward the central axis) further than those of FIG. 2, since there is no cavity to physically dictate the radial length of the parting lines. The solid, central area of the bullet tends to slow down the ulitmate separation of the individual sections during impact which allows greater penetration of a fluidic target. It should be understood that while the jacketed bullet of FIG. 4 is depicted as having a flat, solid nose and six parting lines, other jacketed versions can be manufactured utilizing various combinations such as a hollow point having only three parting lines as seen in FIGS. 1–3, or a pointed soft-point, such as is common in rifle bullets, without departing from the spirit of the invention.

Figure 6:
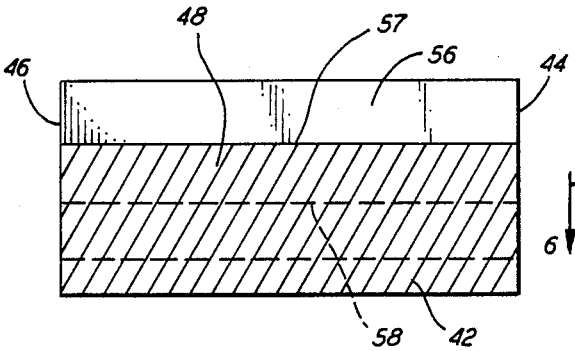
FIG. 6 is a side elevational view in section taken on the line 6—6 of FIG. 5.
Figure 5:
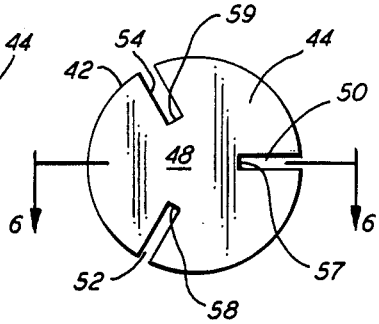
FIG. 5 is an end view of a cylindrical length of metal from which the bullet of the invention is fabricated, showing the appearance thereof after the initial step in the preferred fabrication method.

FIGS. 5 and 6 relate to an extruded, cylindrical body, or, in the case of a jacketed bullet, an extruded, cylindrical core. The preferred method of fabrication of the extruded cylinder and the finished bullet, as well as the geometry of the extruded cylinder will now be described in more detail. A solid, cylindrical slug of suitable malleable metal is placed in an extrusion die having two open ends. Adjacent the distal, open end are three or more longitudinal arms projecting radially inwardly. The slug is first placed in the proximal, open end of the extrusion die and is then forced into the distal end of the die having the projecting arms by a flat-ended punch. The punch is then withdrawn from the die and another solid, cylindrical slug of malleable metal is placed in the die. The flat-ended punch is advanced into the die a second time, moving the second cylinder against the first, expelling the latter from the die, fully extruded. Thereafter, every time a malleable cylinder is placed in the die, and the punch forces a slug to the distal end of the die, a fully extruded cylindrical body or core is expelled.

The fully extruded, cylindrical body is indicated in FIGS. 5 and 6 by reference numeral 42. The extrusion process leaves the cylindrical body of FIG. 5 with a solid, central hub area 48 and three parting channels or spaces 50, 52 and 54 arranged at substantially equal, 120° angles about the central axis of body 42. The inner terminations of parting channels 50, 52 and 54 are indicated in FIG. 5 by reference numerals 57, 58 and 59, respectively. Inner terminations 57 and 58 of parting channels 50 and 52, respectively, are also seen in FIG. 6, wherein the parting channels are seen to extend from flat end 44 through the entire length of the extruded cylindrical body and terminate at the body's base 46. The extruded body may include three or more parting channels, all of which begin at the flat, forward end 44 and extend through the material of the body, lying substantially parallel with its central axis, and terminate at the base 46 of the body. As is evident from FIGS. 5 and 6, parting channels 50, 52 and 54 extend from the outer periphery of the extruded cylinder, radially inwardly and terminate outwardly of the central axis, forming a solid central area at 48. That is, while the parting channels extend completely longitudinally through the cylindrical body, in no instance does any parting channel extend radially to the central axis of the body. Adjacent faces on each side of the parting channels are not joined or affixed to one another in any way. One of the faces on opposite sides of parting channel 50, through which the section is taken, is seen in FIG. 6 and denoted by reference number 56. The preferred width of the channels, defined by the distance between opposing faces, is between 0.015" and 0.030".

Having thus formed extruded body 42 including channels 50, 52 and 54, body 42 is then forced through a profile die to compress channels 50, 52 and 54 of body 42, resulting in parting lines 16, 18 and 20, respectively. Extrusion of body 42 through the profile die simultaneously forms tapered nose 12 and hollow point 15, if desired.

Figure 7:
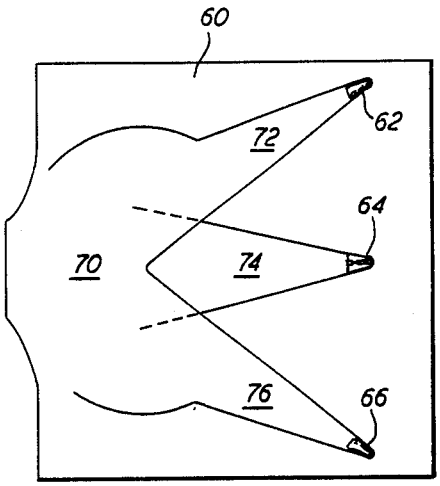
FIG. 7 illustrates the internal appearance of a fluidic target into which a bullet constructed according to the present invention has been fired.
Figure 8:
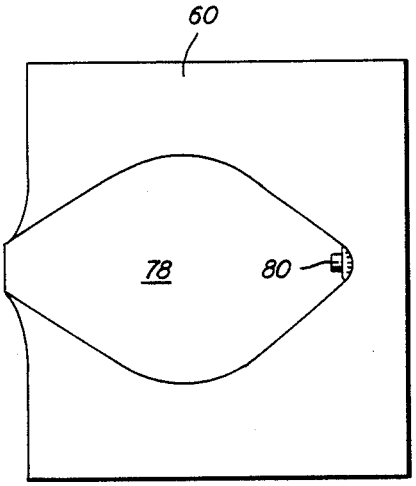
FIG. 8 PRIOR ART
FIG. 8 illustrates the internal appearance of a fluidic target into which a typical mushrooming or hollow point prior art bullet has been fired.

Referring now to FIGS. 7 and 8, the bullet-target interactions occurring after impact with a fluidic target of the bullet of the present invention and a typical prior art bullet of the mushrooming type are respectively illustrated. Identical blocks 60 of 20% ordnance gelatin, the substance used in standardized tests of this nature, were used in actual tests, the results of which are reflected in FIGS. 7–9. The bullet of FIG. 7 was essentially identical to that of FIGS. 1–3 prior to impact. The bullet of FIG. 8, indicated by reference numeral 80, was a typical hollow point bullet having the same initial weight, diameter and impact velocity as the bullet of FIG. 7.

It should be recognized that FIG. 7 does not represent a two-dimensional cross section of gelatin block 60, but is rather an indication of the three-dimensional travel of the bullet, and individual portions thereof, from the time of entering the block to the final positions of all portions. At the point of impact with the target, the bullet was in one piece, as shown in FIGS. 1–3, creating the large portion 70 of the cavity adjacent the side of impact and penetration. Shortly after entering block 60, the bullet separated into three separate and distinct portions, namely three essentially wedge-shaped portions 62, 64 and 66, which are bent outwardly, to a degree, from the original axis of the bullet due to impact forces generated on the bullet's nose during penetration of the target. Portions 62, 64 and 66 are those wedge-shaped portions of the bullet adjacent the previously described parting lines and constitute the entire bullet after impact.

Referring to the embodiment of FIGS. 1, 2 and 3, during impact and penetration of a fluidic target, the bullet's nose 12 expands outwardly, which initiates a tearing action through the web areas 17, 19 and 21, the tearing continuing rearwardly through the solid, central area 10 below the base 22 of cavity 15 ultimately tearing the bullet into three separate pieces 62, 64 and 66, as seen in FIG. 7. It should be pointed out that web thickness regulates the rate of separation of the individual bullet parts as well as the degree and angle of dispersion. In the case of the jacketed soft-point bullet of FIG. 4, the diameter of the solid, central hub area 40 regulates the rate of separation of the individual bullet parts as it shears through itself as it expands, resulting in six separate and distinct portions (not shown). As the bullet of FIG. 4 does not separate as readily as the bullet of FIGS. 1–3, the result is a substantially deeper penetration of a fluidic target. The larger the diameter of solid, central area 40, the slower the separation of the bullet and the deeper the penetration.

After separation of the bullet, wedge-shaped portions 62, 64 and 66 travel separately into the target along paths angled outwardly from the initial axis of bullet travel, forming separate cavities denoted by reference numerals 72, 74 and 76, respectively. From the foregoing explanation, it will be appreciated that in the somewhat diagrammatic representation of FIG. 7, cavities 72 and 76 are closer to the viewer than cavity 70, i.e., closer than the plane of the drawing and angularly disposed with respect thereto. Likewise, cavity 74 is farther from the viewer, i.e. essentially behind cavity 70 in the illustrated orientation.

Bullet 80, on the other hand, remains in a single piece, i.e., in "monoblock" form, after entering the target, and consequently forms but a single cavity 78. The cavities formed by the bullets in both FIGS. 7 and 8, of course, as with any bullet striking and penetrating a fluidic target, are temporary in nature. That is, the elastic nature of the target causes the cavities to quickly diminish in size, whereby the illustrations of FIGS. 7 and 8 may be considered in the nature of high-speed photographs.

The size and dispersion of the temporary cavities are, however, an important indication of the incapacitating effect of a bullet on a living target. Furthermore, the cavities shown very generally in FIG. 7 expand to a much larger size within 1½ milliseconds after portions 62, 64 and 66 have come to rest within the target. In the case of a living target, the effect is that tissue and nerves are trapped and compressed between individual, adjacent, expanding cavities, resulting in maximum motor interruption and rapid incapacitation. This, in combination with the wide radial dispersion of portions 62, 64 and 66, greatly increases the chance of striking or otherwise damaging a vital organ in living target, even when the bullet is poorly placed.

Figure 9:
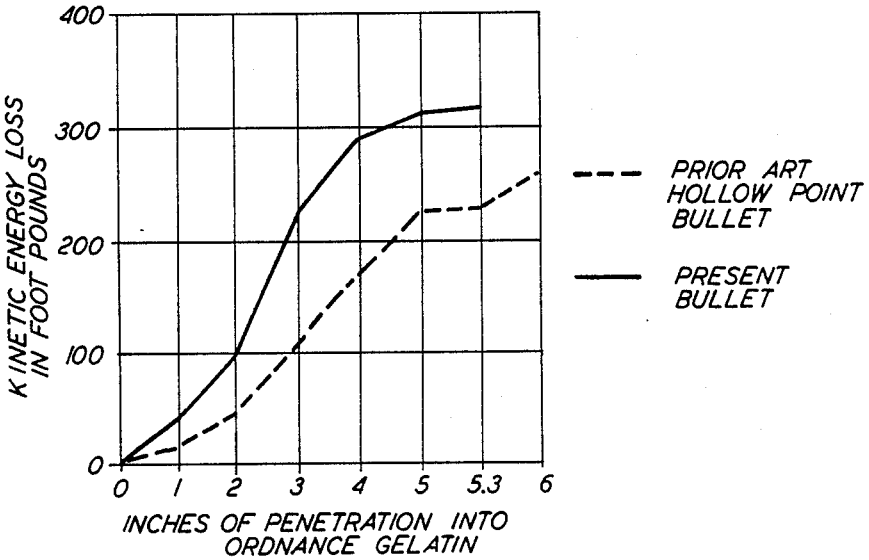
FIG. 9 is a graphical representation of kinetic energy loss versus depth of penetration into a fluidic traget of the bullets of FIGS. 7 and 8.

FIG. 9 provides a graphical comparison of the cumulative kinetic energy delivered or expended by the bullet of the prior att and the present invention per inch of penetration into a fluidic target.

What is claimed is:

1. A bullet comprising a body of malleable material having front and back ends, symmetrical about a central, longitudinal axis, having an outer periphery defined by a substantially cylindrical base portion extending from said back end of said body for a first portion of the axial length thereof, and a nose portion extending intergrally from said base portion for the remainder of the axial length of said body, to said front end thereof, said nose portion tapering from the diameter of said base portion to a smaller diameter at said front end, and a hollow cavity extending from said front end into said nose portion, said cavity being symmetrically formed about said central axis and terminating within said body, and at least three parting lines extending longitudinally from said front end to said back end from said outer periphery radially inwardly and substantially axially parallel to said central axis, said parting lines defining opposing surfaces in mutual contact but physically unattached, said opposing surfaces terminating radially inwardly within said body and outside said cavity a distance sufficient to prevent separation of said body is separate portions during flight, but insufficient to prevent such separation upon impact with a fluidic target, whereby upon impact with such target said body separates into a plurality of separate portions with those portions laterally adjacent said parting lines separating from one another to travel separately and create a plurality of impinging pressure zones within said target.

2. The invention according to claim 1 wherein said parting lines terminate radially a constant distance from said contral axis of said cavity, parallel to said central axis over the full axial extent of said parting lines.

3. The invention according to claim 2 wherein said constant distance is substantially the same for each of said parting lines.

4. The invention according to claim 3 wherein said constant distance is between 0.005" and 0.150" plus the radius of said cavity at said front end.

5. The invention according to claim 3 wherein said parting lines are disposed at equal angles from one another about said central axis.

6. The invention according to claim 5 wherein said front end is substantially flat, lying in a plane perpendicular to said central axis.

7. The invention according to claim 1 wherein said hollow cavity is defined by a frusto-conical wall extending from said front end and decreasing in diameter towards said back end.

8. A bullet comprising a body of malleable material having front and back ends, symmetrical about a central, longitudinal axis, having an outer periphery defined by a substantially cylindrical base portion extending from said back end of said body for a first portion of the axial length thereof, and a nose portion extending integrally from said base portion for the remainder of the axial length of said body, to said front end thereof, said nose portion tapering from the diameter of said base portion to a smaller diameter at said front end, and at least three parting lines extending longitudinally from said front end to said back end and radially from said outer periphery to terminate at a position spaced from said central axis, said parting lines defining opposing surfaces terminating radially and axially within said body to define a central core of a predetermined diameter, said opposing surfaces within said body on opposite sides of said parting lines in mutual contact but physically unattached, said parting lines terminating radially inwardly within said body a distance sufficient from said central axis to prevent separation of said body into separate portions during flight, but insufficient to prevent such separation upon impact with a fluidic target, whereby upon impact with such a target said body separates into a plurality of separate portions with those portions laterally adjacent said parting lines separating from one another to travel separately and create a plurality of impinging pressure zones within said target.

9. The invention according to claim 8 wherein said parting lines terminate radially within said body a constant distance from said central axis over the full axial extent of said parting lines.

10. The invention according to claim 9 wherein said constant distance is substantially the same for each of said parting lines.

11. The invention according to claim 8 wherein said predetermined diameter of said core is between about 0.020" to 0.300".

12. The invention according to claim 10 wherein said parting lines are disposed at equal angles from one another about said central axis.

13. The invention according to claim 8 wherein said front end is blunt.

* * * * *